US006468004B1

(12) United States Patent
Price

(10) Patent No.: US 6,468,004 B1
(45) Date of Patent: Oct. 22, 2002

(54) SOIL REINFORCEMENT

(76) Inventor: Derrick Ian Peter Price, 17B Ellington Road, Muswell Hill, London N10 3DD (GB)

( * ) Notice: Subject to any disclaimer, the term of this patent is extended or adjusted under 35 U.S.C. 154(b) by 0 days.

(21) Appl. No.: 09/509,002

(22) PCT Filed: Sep. 28, 1998

(86) PCT No.: PCT/GB98/02912

§ 371 (c)(1),
(2), (4) Date: Apr. 25, 2000

(87) PCT Pub. No.: WO99/16979

PCT Pub. Date: Apr. 8, 1999

(30) Foreign Application Priority Data

Sep. 29, 1997 (GB) ..... 9720632

(51) Int. Cl.[7] ..... E02D 17/20
(52) U.S. Cl. ..... 405/262; 405/284; 405/286
(58) Field of Search ..... 405/262, 284, 405/286; 52/603, 604, 605

(56) References Cited

U.S. PATENT DOCUMENTS 4,324,508 A * 4/1982 Hilfiker et al. ..... 405/284
4,616,959 A * 10/1986 Hilfiker ..... 405/286
4,661,023 A * 4/1987 Hilfiker ..... 405/262
4,824,293 A 4/1989 Brown et al.
5,370,480 A * 12/1994 Quaney ..... 405/284
5,642,968 A * 7/1997 Anderson et al. ..... 405/286
6,086,288 A * 7/2000 Ruel et al. ..... 405/284
6,113,317 A * 9/2000 Myers ..... 405/284

FOREIGN PATENT DOCUMENTS

| | | | | |
|---|---|---|---|---|
| DE | 2924310 | | 1/1980 | |
| FR | 2650849 | * | 8/1989 | ..... E02D/29/02 |
| GB | 2014222 | | 8/1979 | |
| WO | 9413890 | | 6/1994 | |

OTHER PUBLICATIONS

US 6,089,793, 7/2000, Rainey (withdrawn)*

* cited by examiner

*Primary Examiner*—Robert E. Pezzuto
*Assistant Examiner*—Alexandra K. Pechhold
(74) *Attorney, Agent, or Firm*—Dykema Gossett PLLC

(57) ABSTRACT

A facing element for a reinforced soil structure has first and second adjoining chamber. A polymeric strip to be secured to the facing element is circumflected about a non-metallic member, and the member and a portion of the circumflected strip are inserted into the first chamber and moved laterally into the second chamber where they are retained in wedged-engagement. The first chamber is sealed to prevent removal of the rod.

17 Claims, 4 Drawing Sheets

SOIL REINFORCEMENT

BACKGROUND OF THE INVENTION

1. Field of the Invention

This invention relates to reinforced soil structures, and it is particularly concerned with a method of and apparatus for securing flexible polymeric strips to a facing for such a structure.

2. The Prior Art

The technique of using polymeric strips in compacted granular fill behind a lightweight reinforced concrete facing is well known, and several ways of connecting the strips to the facing have been employed. For instance, metallic loops are secured to the panels which form the facing, and the strip is circumflected alternately about the loops and anchoring points within the fill.

SUMMARY OF THE INVENTION

The present invention provides a facing element for a facing of a reinforced soil structure including a polymeric strip circumflected about an attachment member, wherein the element defines a first chamber for receiving the member and a portion of the circumflected strip, and a second chamber laterally adjoining and connected to the first chamber for receiving and retaining the member and the circumflected strip portion therein, the chambers opening to the rear face of the element.

Preferably, the relative dimensions of the second chamber and the attachment member serve to retain an interjacent strip portion in wedged engagement therebetween. Subsequent movement of the facing or the strip e.g. as the soil structure settles, wedges the attachment member and the interjacent strip portion more securely within the second chamber.

The fibres in the strip can be damaged by excessive compressive loading, and thus in a preferred embodiment opposed converging surfaces of the second chamber define an abutment zone, the converging surfaces and the adjacent attachment member surfaces being substantially parallel over the area of the abutment zone when the interjacent strip portion is wedged therebetween thereby to spread the load on the interjacent strip portion over the area of the abutment zone.

According to another aspect of the invention, there is provided an assembly for use in a reinforced soil structure comprising a polymeric strip, the assembly comprising an attachment member and a facing element as defined above.

To improve the resistance of the attachment member to corrosion, the attachment member is preferably formed from non-metallic material.

The invention also provides a method of securing a polymeric strip to a facing element of a reinforced soil structure, the method comprising the steps of:

circumflecting the strip about an attachment member;

inserting the attachment member and a portion of the circumflected strip into a first chamber opening to the rear of the element; and moving the attachment member and the strip portion laterally into a second chamber for receiving and retaining the attachment member and the circumflected strip portion, the second chamber adjoining and connecting to the first chamber and opening to the rear of the element.

A clear understanding of the invention will be gained from the following detailed description of embodiments, given by way of example only, with reference to the accompanying drawings.

DETAILED DESCRIPTION OF THE PREFERRED EMBODIMENTS

A facing for a reinforced soil structure is generally formed by an isodomous arrangement of panels or blocks, e.g., of concrete, steel or fibreglass. The panels may interengage or interlock to strengthen the facing, and to distribute the load placed on the individual panels. The facing is supported against the loads imposed by the soil structure by strips of polymeric material which are secured to the facing and which extend from the facing into the soil structure.

Figure 1:
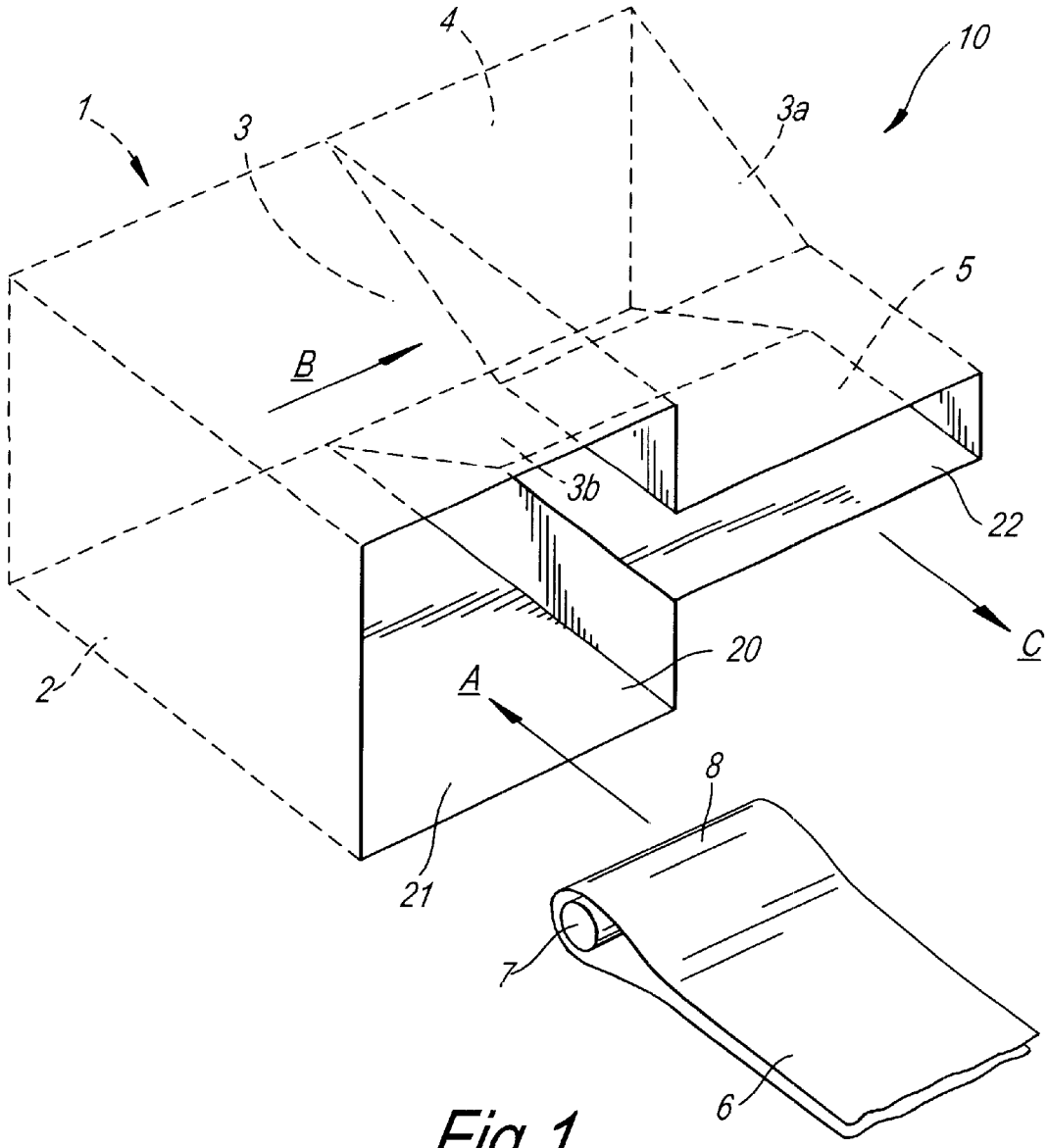
FIG. 1 is an illustrative perspective view of an opening and associated chambers in an element according to the invention.

FIG. 1 illustrates a substantially rectilinear opening or entrance, generally designated 20, in the rearward face of a panel 10. The opening has a first aperture 21 adjacent a second, relatively restricted, aperture 22. The first and second apertures 21, 22 communicate with respective first and second chambers 2, 3. The first chamber 2 has a generally parallelepiped configuration. The second chamber 3 has a substantially frustocunate inner portion 4 whose opposed walls 3*a*, 3*b* taper toward a contiguous generally paralielelepiped outer portion 5. The height of the second aperture 22 and the outer portion of the second chamber 3 are less than that of the first aperture 21 and the chamber 2. The apertures 21, 22 and the respective chambers 2, 3, which together define a cavity 1, adjoin along a common edge or face to allow communication between them.

A polymeric strip, i.e. a strip 6 of drawn or aligned fibres encased in a protective sheath of PVC or polyethylene, which is to be secured to the panel is circumflected about an elongate rod or beam 7. The depth and width of the strip 6 are typically in the ranges 1 to 2 mm and 80 to 90 mm respectively. The rod 7 is preferably formed from polypropylene, polyethylene, glass-filled polyethylene or any other suitable polymer. Other examples of material the rod could be formed from include ceramics, a carbon fibre composite material or a corrosion resistant metallic material. The front edge of the outer portion 5 of the second chamber 3 may be rounded to avoid damage to the polymeric strip.

To secure the strip 6 to the panel 10, the rod 7 and the adjacent circumflected portion 8 of the strip 6 are inserted into the first aperture 21 (movement A). After insertion, the circumflect portion 8 of the strip 6 and the rod 7 are moved laterally (B) to position the rod 7 and the circumflect portion 8 behind the second aperture 22. The relative dimensions of the rod 7 and the second aperture 22 prevent the removal of the rod 7 and the adjacent portion 8 of the strip 6 thereby securing the strip to the panel. Positioning the rod 7 in the frustocunate inner portion 4 of the second chamber results in tensioning (C) of the strip 6 bringing the rod 7 and the adjacent circumflected portion 8 of the strip 6 into wedged engagement with the inner portion 4 of the second chamber 3. The height of the second aperture 22 and the outer portion 5 of the second chamber are sufficient to accommodate two thicknesses of the strip 6, but they are too small for the attachment member and the adjacent portion of the strip to fit through. After the strip is tensioned, the first aperture 21 and the associated chamber are filled, e.g. with mortar, to seal the rod 7 within the block and thus ensure that the strip cannot become detached from the structure.

To form the cavity 1, a mould or cast, e.g. of polystyrene, PVC or low density polyethylene, corresponding to the shape of the cavity is positioned within the frame in which the panel 10 is formed, concrete or another suitable material is poured into the frame, and the mould is dismantled or destroyed and removed after the concrete panel 10 has set. The mould may be sculpted from a single piece of material, or it could be formed by a number of distinct sections which are secured together by a suitable adhesive or other fasteners. Preferably, the section of the mould which defines the second chamber 3 is formed by extrusion.

The specific configuration of the cavity may vary. The first aperture 21 and the chamber 2 may be of any configuration, e.g. hemispherical or cylindrical, but the size of the first aperture and chamber should be sufficient to accommodate the rod 7 and the circumflected portion 8 of the strip 6 and to enable the rod 7 and strip 6 to be moved into the adjoining second chamber 3. Also, the inner portion 4 of the second chamber need not be wedge-shaped, and it could for instance be cylindrical, trapezoidal or quadriform in configuration (see FIG. 5). However, the second chamber should define an inner portion capable of receiving the member and the strip and a barrier or bottleneck between the inner portion and the rear of the panel of a width less than the width of the rod 7 together with two thicknesses of the strip 6 but greater than two thicknesses of the strip 6 for retaining the member 7 and the adjacent portion of the strip 6. The junction between the inner and outer portions 4,5 of the second chamber 3 may be rounded to reduce the chance of damage to the abutting portion of the strip 6.

Figure 5A:
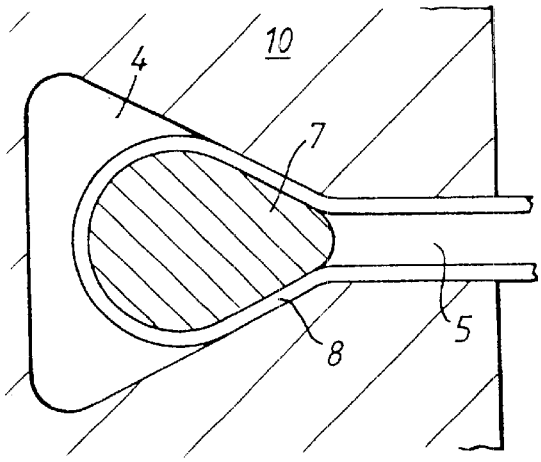
FIGS. 5*a* to 5*d* are similar views to FIG. 4 showing alternative embodiments of the invention.
Figure 5B:
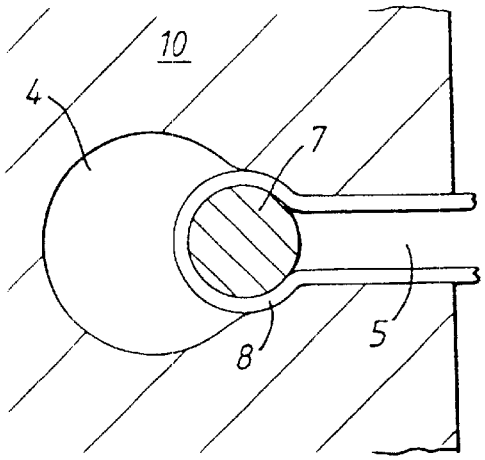
Figure 5C:
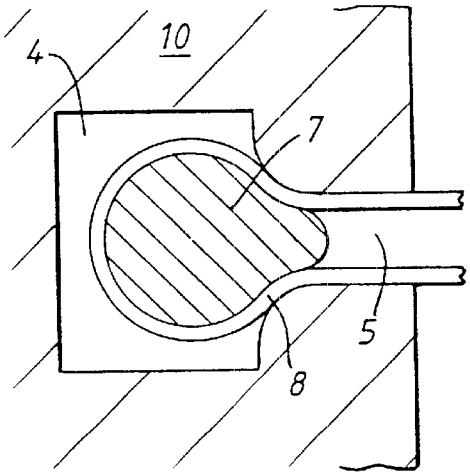
Figure 5D:
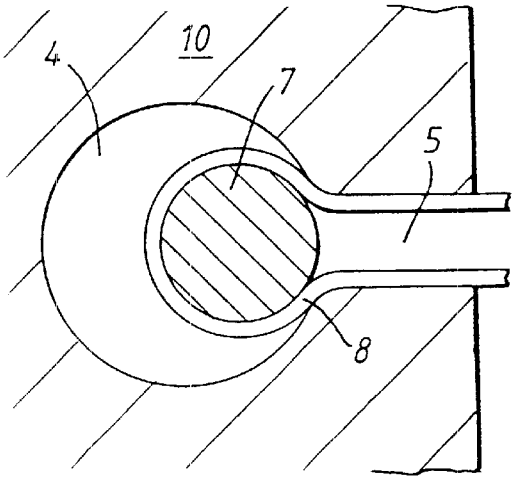

Also, the rod 7 and the second chamber 3 can be configured to have elongate parallel surfaces in the abutment zone, i.e. the area in which the rod and the second chamber sandwich the strip 8. For instance if the inner portion of the second chamber is wedge-shaped the rod can be substantially pear-shaped (FIG. 5*a*). The enlargement of the abutment zone reduces the intensity of the compressive load on the sandwiched portion of the strip and on the rod 7. The load on the rod 7 may be reduced to the extent that it can be formed from a cementitious material such as cement grout.

The width and depth of the strip are typically in the ranges of 80 mm to 90 mm and 1 mm to 2 mm respectively. The length of the rod is equal to or greater than the strip width, and if the width of the strip is in the range of 80 mm to 90 mm, the rod length may be approximately 100 mm. The compressive load on the strip can be significantly reduced by having the surfaces in the abutment zone parallel over a length of at least 20 mm, and preferably the surfaces are parallel over 30 mm to 40 mm.

During construction of a reinforced soil structure, the facing and soil e.g. compacted granular fill 30, are built up in layers. The panels according to the invention may be interspersed with conventional panels, i.e. panels without a cavity for receiving and retaining the polymeric strip. A drainage layer may be provided immediately behind the facing and a geotextile strip 32 may be disposed between the granular fill 30 and the drainage layers 31 to prevent soil particles clogging up the drainage layer.

One or more anchoring bars or shafts are disposed in the soil behind the facing on the same horizontal levels as the assemblies or elements according to the invention. A continuous portion of strip 5 is circumflected about a first rod 7, an anchoring bar, a second rod adjacent the first rod etc., to produce a zig-zag strip configuration.

Figure 2:
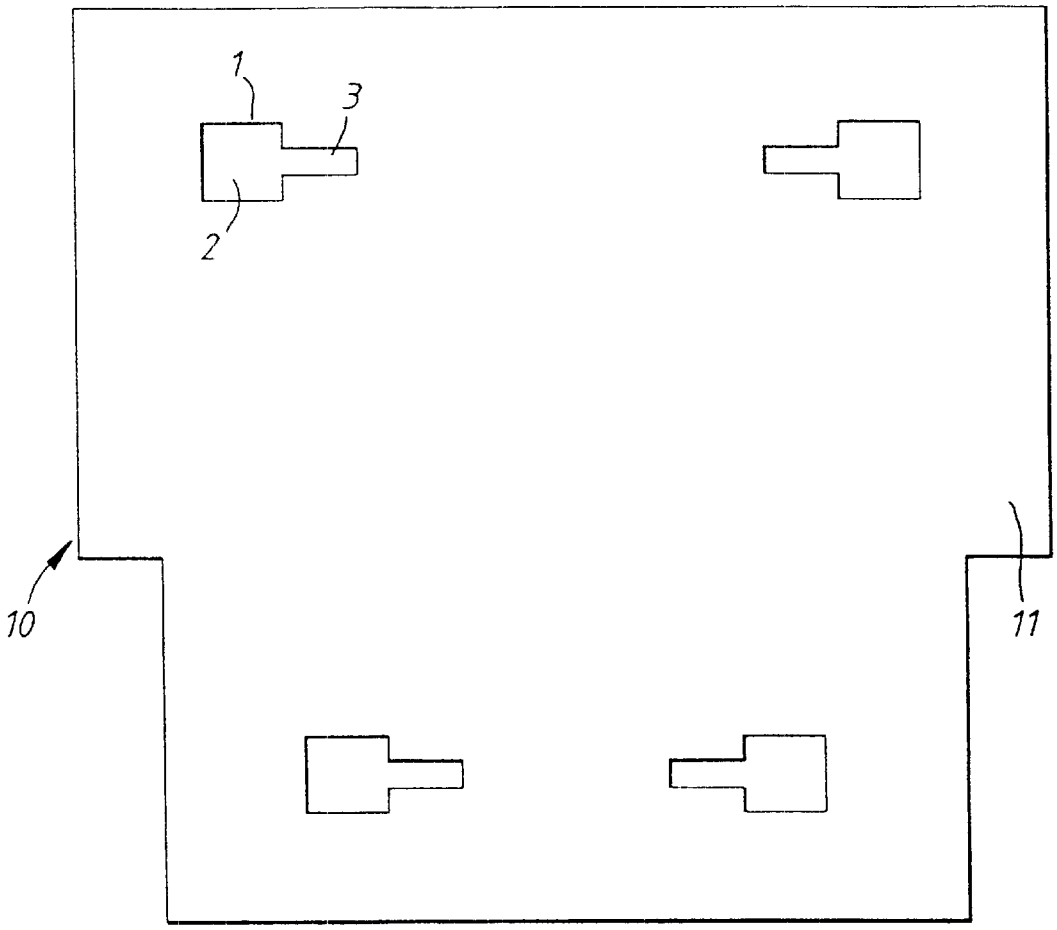
FIG. 2 is a rear view of one embodiment of an element.
Figure 3:
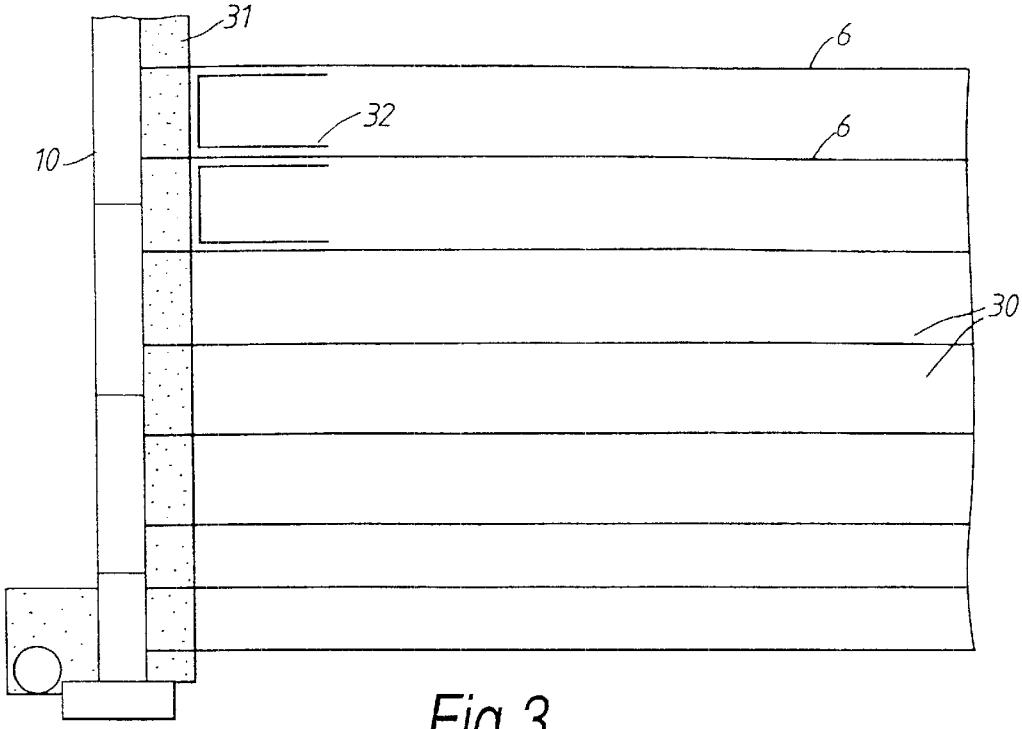
FIG. 3 is a cross-sectional view through a reinforced structure incorporating the invention.
Figure 4:
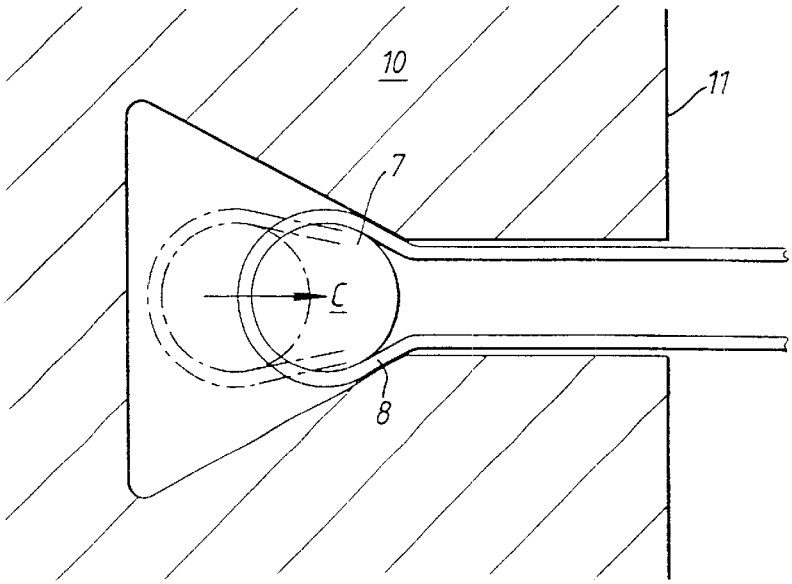
FIG. 4 is an illustrative cross-sectional view through an element and attachment member in situ.

Of course, modifications to the described embodiments may be made without departing from the scope of the invention. For instance the rear face 11 of the panel 10 may be buttressed or otherwise reinforced in the region of the cavity if the thickness of the panel in that area is not sufficient to withstand the load imposed by the strip on the panel. Also, more than one cavity can be disposed in a single panel, and for instance a cavity could be located near each corner of the panel (see FIG. 2). Further, the cavity may be accessible from both the front and the back of the panel to facilitate the location of the attachment member. The panel and the rod should be configured to avoid sharp corners in the areas of contact with the strip to minimise the chances of damage to the strip.

What is claimed is:

1. A facing element for a facing wall of a reinforced soil structure comprising a polymeric strip circumflected about an elongated attachment member, said facing element defining a front face, a rear face, lateral sides, a first chamber therein which opens to said rear face at a first opening, and a second chamber therein located laterally of said first chamber and which opens to said rear face at a second opening, said second chamber being in communication with said first chamber, said first opening having a first height and a first width and said second opening having a second height and a second width, said second height being less than said first height and less than a thickness of said attachment member, so that said attachment member with circumflected strip, after insertion through said first opening and into said first chamber, can be laterally moved from said first chamber into said second chamber to be retained therein with said strip then extending through said second opening.

2. A facing element according to claim 1, wherein the relative dimensions of the second chamber and the attachment member serve to retain an interjacent strip portion in wedged engagement therebetween.

3. A facing element according to claim 2, wherein opposed converging surfaces of the second chamber define an abutment zone, the converging surfaces and the adjacent attachment member surfaces being substantially parallel over the area of the abutment zone when the interjacent strip portion is wedged therebetween thereby to spread the load on the interjacent strip portion over the area of the abutment zone.

4. A facing element according to claim 3, wherein the converging surfaces are substantially planar.

5. A facing element according to claim 1, wherein the first and second chambers together define a cavity, and a plurality of cavities are provided.

6. A facing element according to claim 5 wherein a cavity is provided in a region of each corner of the element.

7. A facing element according to claim 1, wherein the first chamber opens to the front face of the element.

8. A facing element according to claim 1, wherein the second chamber opens to the front face of the element.

9. A method of securing a polymeric strip to a facing element of a reinforced soil structure, the facing element having a front face and a rear face and defining a first chamber which communicates with a first opening in the rear face and a second chamber therein which communicates with a second opening in the rear face, the second chamber being positioned laterally of the first chamber and in communication therewith, said first opening having a first height and a first width and said second opening having a second height and a second width, said second height being less than said first height and less than a thickness of said attachment member, the method comprising the steps of:

circumflecting the strip about an elongated attachment member, said attachment member having a thickness which is less than said first height but more than said second height;

inserting the attachment member and a portion of the circumflected strip through the first opening into the first chamber; and moving the attachment member and the strip portion laterally into the second chamber for receiving and retaining the attachment member and the circumflected strip portion, the strip extending through the second opening thereof in the rear face.

10. A method according to claim 9 wherein the second chamber has opposed converging walls and the strip and attachment member are pulled into wedged engagement with said opposed converging walls.

11. A method according to claim 10 wherein the first chamber is sealed to prevent withdrawal of the attachment member subsequent to the movement of the attachment member and the circumflected strip portion into the second chamber.

12. A reinforced soil structure comprising a facing element having a polymeric strip circumflected about an attachment member, wherein the facing element defines a first chamber for receiving the member and a portion of the circumflected strip, and a second chamber laterally adjoining and connected to the first chamber for receiving and retaining the member and the circumflected strip portion therein, the first and second chambers separately opening to the rear face of the element at respectively first and second openings, said first opening having a first height and a first width and said second opening having a second height and a second width, said second height being less than said first height and less than a thickness of said attachment member.

13. An assembly for use in a reinforced soil structure comprising a polymeric strip, the assembly comprising an attachment member and a facing element having the polymeric strip circumflected about an attachment member, wherein the element defines a first chamber for receiving the member and a portion of the circumflected strip, and a second chamber laterally adjoining and connected to the first chamber for receiving and retaining the member and the circumflected strip portion therein, the first and second chambers separately opening to the rear face of the element at respectively first and second openings, said first opening having a first height and a first width and said second opening having a second height and a second width, said second height being less than said first height and less than a thickness of said attachment member.

14. An assembly according to claim 13, wherein the attachment member is formed from a non-metallic material.

15. An assembly according to claim 14, wherein the attachment member is formed from a cementitious material.

16. An assembly according to claim 13, wherein said attachment member has a substantially wedge-shaped cross section.

17. A reinforced soil structure comprising an assembly having a polymeric strip, the assembly comprising an attachment member and a facing element having the polymeric strip circumflected about an attachment member, wherein the facing element defines a first chamber for receiving the attachment member and a portion of the circumflected strip, and a second chamber laterally adjoining and connected to the first chamber for receiving and retaining the attachment member and the circumflected strip portion therein, the first and second chambers separately opening to the rear face of the element at respectively first and second openings, said first opening having a first height and a first width and said second opening having a second height and a second width, said second height being less than said first height and less than a thickness of said attachment member.

* * * * *